US005666666A

United States Patent [19]

Chaffen et al.

[11] Patent Number: 5,666,666

[45] Date of Patent: Sep. 16, 1997

[54] NECKWEAR

[76] Inventors: Barry Chaffen; Gwen S. Chaffen, both of 5630 N. Sheridan #907, Chicago, Ill. 60660

[21] Appl. No.: 593,079

[22] Filed: Jan. 29, 1996

Related U.S. Application Data

[63] Continuation-in-part of Ser. No. 474,318, Jun. 7, 1995, abandoned.

[51] Int. Cl.[6] ..... A41D 25/00; A41D 25/02; A41D 25/16

[52] U.S. Cl. ..... 2/148; 2/149; 2/150; 2/152.1; 2/153; 2/156

[58] Field of Search ..... 2/144, 145, 146, 2/147, 148, 149, 150, 151, 152.1, 153, 154, 155, 156, 157, 52, 916

[56] References Cited

U.S. PATENT DOCUMENTS

| | | | |
|---|---|---|---|
| 2,040,297 | 5/1936 | Costantini | 2/150 |
| 2,170,707 | 8/1939 | Chapel . | |
| 2,408,455 | 10/1946 | Taborski . | |
| 2,495,614 | 1/1950 | Vandermark . | |
| 2,565,149 | 8/1951 | Shea . | |
| 2,644,163 | 7/1953 | Guaschino . | |
| 2,736,033 | 2/1956 | Brunetti et al. . | |
| 2,746,055 | 5/1956 | Gleason . | |
| 3,263,237 | 8/1966 | Bellon . | |
| 3,562,004 | 2/1971 | Brandenberger . | |
| 3,735,420 | 5/1973 | New | 2/150 |
| 3,955,217 | 5/1976 | Levy | 2/150 |
| 4,173,792 | 11/1979 | Intengan | 2/150 X |
| 4,246,658 | 1/1981 | Liaw | 2/152.1 |
| 4,827,536 | 5/1989 | Sung . | |
| 5,010,593 | 4/1991 | Stevens, Jr. | 2/148 |
| 5,035,002 | 7/1991 | Knight . | |
| 5,084,916 | 2/1992 | Austin | 2/153 X |
| 5,088,120 | 2/1992 | Yen | 2/153 X |
| 5,353,438 | 10/1994 | Voiles . | |
| 5,400,439 | 3/1995 | Petroff . | |

*Primary Examiner*—Jeanette E. Chapman
*Attorney, Agent, or Firm*—Richard C. Litman

[57] ABSTRACT

A ready-to-wear neckwear apparatus including a malleable tie knot-shaped insert, conformable to the contours of the wearer's neck. The insert is received in an insert sleeve with adjustable neck band. Front and rear body members attach to the front and rear of the insert sleeve, respectively, and are joined therebelow. A cover having slits for the neck band, wraps around the insert, insert sleeve and body members appearing like a conventional tie knot. The cover and rear body member have a slot and groove, respectively, defining a continuous button groove along the length of the neckwear for inserting shirt buttons therein.

9 Claims, 4 Drawing Sheets

NECKWEAR

CROSS-REFERENCE TO RELATED APPLICATION

This is a continuation-in-part of application Ser. No. 08/474,318 filed Jun. 7, 1995 abandoned.

BACKGROUND OF THE INVENTION

1. Field of the Invention

This invention relates to neckwear. More specifically, the present invention relates to pre-fabricated neckties including multiple means for securing a necktie to a wearer.

2. Description of the Prior Art

Traditionally, a necktie is constructed from fine cloth into a long, tapered strip having hemmed edges. One end, "wide end" hereinafter, is wider than the other end, "narrow end" hereinafter. Necktie wearers drape the middle section around the wearer's neck and, selecting from a plurality of knot styles, secure the necktie around the neck, inside the collar of a shirt.

Neckties are either a source of sartorial splendor or excruciating embarrassment. A well made necktie fashioned properly makes an excellent accent for a suit of clothes. Aesthetically pleasing or not, however, many complaints have been lodged against them. Such complaints include the time and frustration associated with tying them and trying to achieve consistent knots from day to day. Ties notoriously catch updrafts and perch on the shoulders of their unsuspecting owners or stray into gravies and other soilants. Sometimes the top portion of a necktie stands away from the shirt when the knot is pinched by the collar. Finally, necktie wearers are limited to a narrow range of sizes, shapes and colors.

A need exists for neckwear that is easy to tie, assumes consistent knots, sustains a close relationship with the wearer and comes in a wider array of styles.

Several types of neckwear are described in the literature. For example, U.S. Pat. No. 2,170,707, issued Aug. 22, 1939, to Charles A. Chapel, describes a necktie apparatus. The apparatus includes an open-ended frusto-conical-shaped frame wrapped with material. The wearer drapes the middle section of the tie around the wearer's neck, inserts the wide end and the narrow end into the wider opening of the frame and slides the frame up both ends toward the wearer's neck.

U.S. Pat. No. 2,408,455, issued Oct. 1, 1946, to Alfred F. Taborski et al., describes a necktie. The necktie includes a forwardly disposed frusto-conical-shaped frame with a rearwardly disposed slot for suspending the frame from a button. Two wires having eyes extend from the top of the frame in opposite directions from each other. A lower wire having a rectangular shape has spring means for frictionally engaging with the lower portion of the frame. Material covers the frame and lower wire. An adjustable band having hooks disposed in each eye secures the device to the wearer's neck.

U.S. Pat. No. 2,495,614, issued Jan. 24, 1950, to Louis Vandermark, describes a necktie including a traditional tie with a truncated narrow end. The narrow end is folded forward over a band that encircles the wearer's neck. The narrow end is folded down on top of the wide end. The corners of the narrow end are folded behind the wide end and clipped.

U.S. Pat. No. 2,565,149, issued Aug. 21, 1951, to John P. Shea, describes a necktie accessory having a frusto-conical-shaped frame with open ends. A neck band secures the frame to the wearer. The wide and narrow ends of a tie are received in the large opening of the frame and are guided out through the small opening.

U.S. Pat. No. 2,644,163, issued Jul. 7, 1953, to Louis Guaschino, describes a necktie dimpler which includes a frame constructed from a T-shaped member. The T is bent along the vertical axis. The ends of the horizontal member of the T touch. The lower portion of the T forms a U-shaped trough. The wide end of the tie is inserted through the top of the frame and located where the knot is fashioned. The frame constricts the wide end and forms a dimple therein.

U.S. Pat. No. 2,736,033, issued Feb. 28, 1956, to Leohello Brunetti et al., describes a necktie retainer. The necktie retainer includes a traditional necktie, into the backside of the wide end of which are disposed a large horizontal slot and a plurality of small horizontal slots. The narrow end of the tie inserts into the large slot. A button may be inserted into one of the small slots.

U.S. Pat. No. 2,746,055, issued May 22, 1956, to James D. Gleason, describes a hold down necktie including a traditional necktie, into the backside of the wide end of which are disposed two large horizontal slots and a plurality of small vertical slots therebetween. The narrow end of the tie inserts into the large slots. A button may be inserted into one of the small slots.

U.S. Pat. No. 3,263,237, issued Aug. 2, 1966, to Robert E. Bellon, describes a pre-knotted necktie which includes a triangular-shaped panel having rolled cylindrical flanges on two edges. The wide end is receive through one of the flanges. The narrow end is received in the other flange. The device is slid up toward the wearer's neck along the wide and narrow ends.

U.S. Pat. No. 3,562,004, issued Sep. 1, 1970, to Fred Brandenberger describes a necktie and removable knot. The device includes a split frusto-conical-shaped frame having open ends. The edges along the split have flanges to permit interengagement thereof. The wide and narrow ends are received in the large opening and are guided out through the small opening.

U.S. Pat. No. 4,173,792, issued Nov. 13, 1979, to Franklin S. Intengan, describes an adjustable length simulated knotted necktie combination. The combination includes a trapezoid-shaped frame having a trapezoid-shaped slot extending through the smallest side of the frame. The wide end of the tie is draped forwardly over the largest side of frame. The narrow end of the tie is received in the slot. The invention includes a generally inverted T-shaped swatch of material connected to a neck band. The ends of the horizontal member of the T encircle the opposed converging sides and are joined. The end of the vertical member of the T wraps over the top of the frame and is joined to the horizontal member junction.

U.S. Pat. No. 4,827,536, issued May 9, 1989, to Henry H. Sung, describes a necktie with holding means having frictional engagement means on both sides. One side attaches to the label on the reverse side of the wide end. The other side attaches to a button.

U.S. Pat. No. 5,010,593, issued Apr. 30, 1991, to Carl T. Stephens, Jr., describes a decorative necktie knot cover which includes a blank of material which may be formed into a frusto-conical-shaped sleeve having open ends. When so formed, the sleeve includes a tab extending across the large sleeve opening. Another embodiment of the invention includes two blanks of material attached by a material strip. The blanks are folded toward each other and fastened thus forming a frusto-conical-shaped sleeve with an open lower end and a partially open upper end. The wide and narrow ends are received in the large opening and are guided out through the small opening.

U.S. Pat. No. 5,353,438, issued Oct. 11, 1994, to Reggie Voiles, describes a necktie restraint including a strip of material having an aperture at one end and a longitudinal slot in the other. The slotted end is looped around the label under the reverse side of the wide end and inserted into the aperture. The slot then receives a button.

U.S. Pat. No. 5,035,002, issued Jul. 30, 1991, to Charles F. Knight, describes a knot cover for ties and scarfs. The knot cover includes a flattened, partial frusto-conical-shaped frame having an open top and bottom. The wide and narrow ends are inserted through the top. The frame is slid along the wide and narrow ends toward the wearer's neck.

U.S. Pat. No. 5,400,439, issued Mar. 28, 1995, to Jordan Petroff, describes a knotless necktie. The Petroff necktie includes a knotshaper formed to simulate a knot. The knotshaper includes an integral padded tongue which is folded down to hold a separate front streamer in the knotshaper. A neck band is attached to one side of the knotshaper. The neck band encircles a wearer's neck, passes through the knotshaper, and hangs behind the steamer like the narrow end of a traditional tie. The streamer must be assembled with the knotshaper and the neck band must be adjusted by the user. There is no provision to keep the knotshaper from protruding from the collar of the wearer's shirt.

Clearly, the above demonstrates a need for integrated, body-conforming neckwear having a continuous button groove.

None of the above references, taken alone or in combination, are seen as teaching or suggesting the presently claimed neckwear.

SUMMARY OF THE INVENTION

The present invention overcomes the limitations of the above inventions by providing ready-to-wear neckwear imposing on the wearer only the burden of having to put it on. The invention includes a malleable, tie knot-shaped insert that adjusts to the contours of the wearer's neck. The insert is received in an insert sleeve. The insert sleeve includes an adjustable neck band for attaching the invention to the wearer's neck. Front and rear body members attach to the front and rear of the insert sleeve, respectively, and are joined therebelow. A cover having slits for the neck band, wraps around the insert, insert sleeve and body members appearing like a conventional tie knot. The rear body member includes a button groove for holding the tie in place along a wearer's shirt front by retaining some of the buttons of the shirt front.

In consideration of the above, an object of the invention is to provide neckwear that retains an aesthetically pleasing appearance throughout the life of the invention.

Another object of the invention is to provide neckwear that is held in place by button groove which engages button on the wearer's shirt.

A further object of the invention is to provide neckwear having a malleable tie knot insert that conforms to the wearer's neck shape.

An additional object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENT

Figure 1:
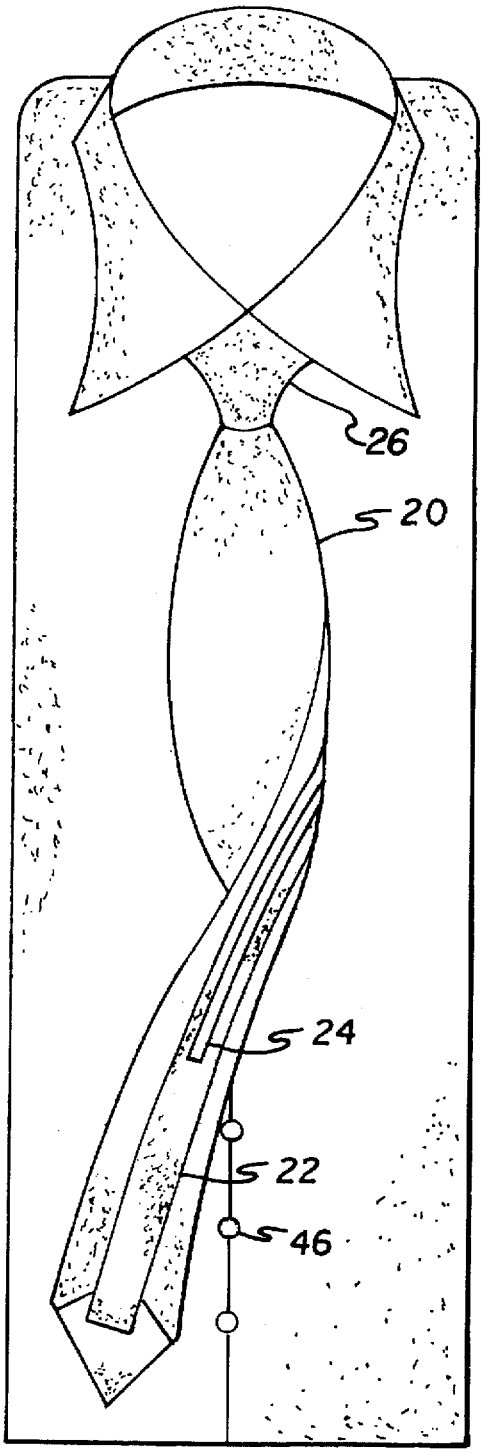
FIG. 1 is environmental perspective view of the invention attached to a shirt.

Referring to FIG. 1, the invention is shown attached to a shirt. The neckwear resembles conventional neckwear in every respect, except that the knot and its relation to the wearer's neck is consistently impeccable every time the neckwear is worn. The invention includes cover 26 wrapped around a knot-shaped member 8 (shown in FIG. 4). Extending downward from between the cover 26 and the knot-shaped member 8 are a front body member 20 and a rear body member 22. The invention thus appears as a traditional tie with the cover 26 encasing knot-shaped member 8 appearing as a traditional knot. The front body member 20 appears as the wide end and the rear member 22 appears as the narrow end of a traditional tie. The rear member 22 includes a groove 24 for holding the tie in place on a shirt front. The groove 24 is configured to engage buttons 46 on the shirt front. Front member 20 is stitched to rear member 22, thus, front member 20 also remains in its proper position along the shirt front.

Figure 2:
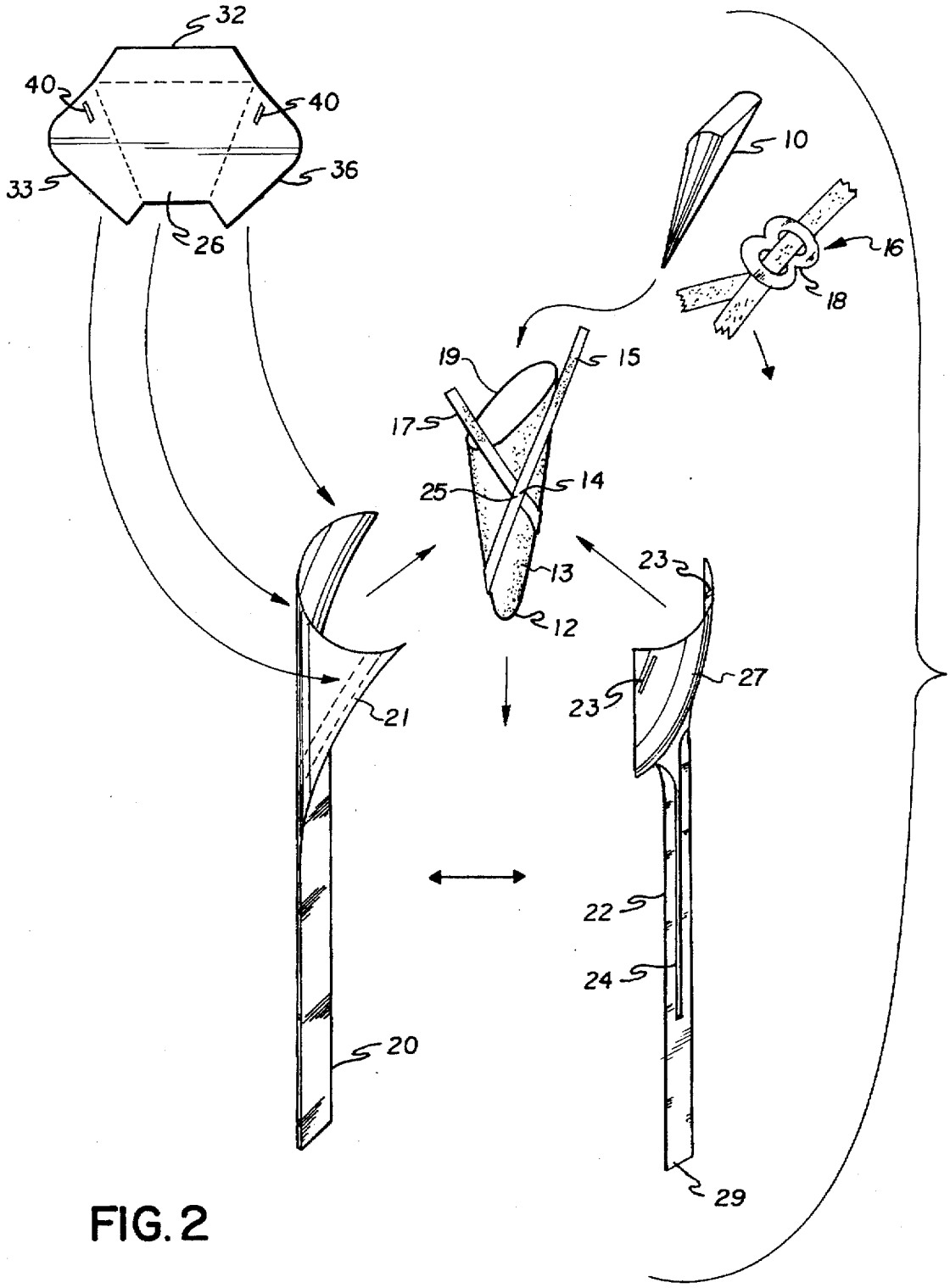
FIG. 2 is an exploded view of the invention.

Referring to FIG. 2, the invention includes an insert 10 and an insert sleeve 12 to which a neck band 14 is attached. The insert 10 may be constructed of a plastic or rubber material that is malleable and adjustable to the contours of the wearer's neck, yet sufficiently resilient to retain the knot shape. The insert 10 also may be constructed from a bladder (not shown) filled with a gas, such as air, a non-viscous fluid, such as water, or a viscous fluid, such as silicone.

Figure 4:
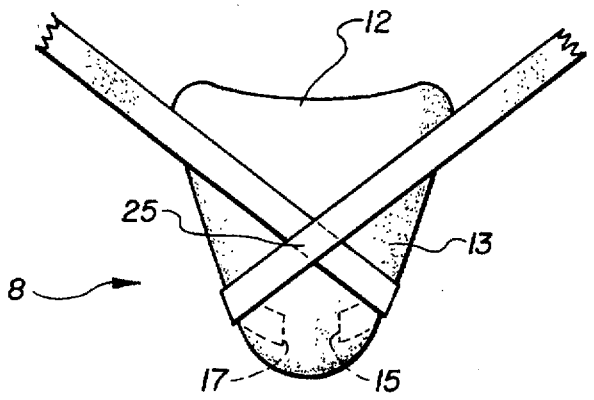
FIG. 4 is a rear elevational view of the insert sleeve and neck band attachment.

The insert sleeve 12 receives the insert 10 to form knot-shaped member 8 (shown in FIG. 4). The insert sleeve 12 may be constructed from any material and includes a front 19 and back 13. An adjustable neck band 14 attaches to insert sleeve 12. The insert sleeve 12 and neck band 14 combination is the preferred embodiment, as opposed to mounting the neck band 14 directly on the insert 10. A stitched connection between the neck band 14 and insert sleeve 12 will last longer than an adhesive connection between the neck band 14 and insert 10 directly.

Figure 3:
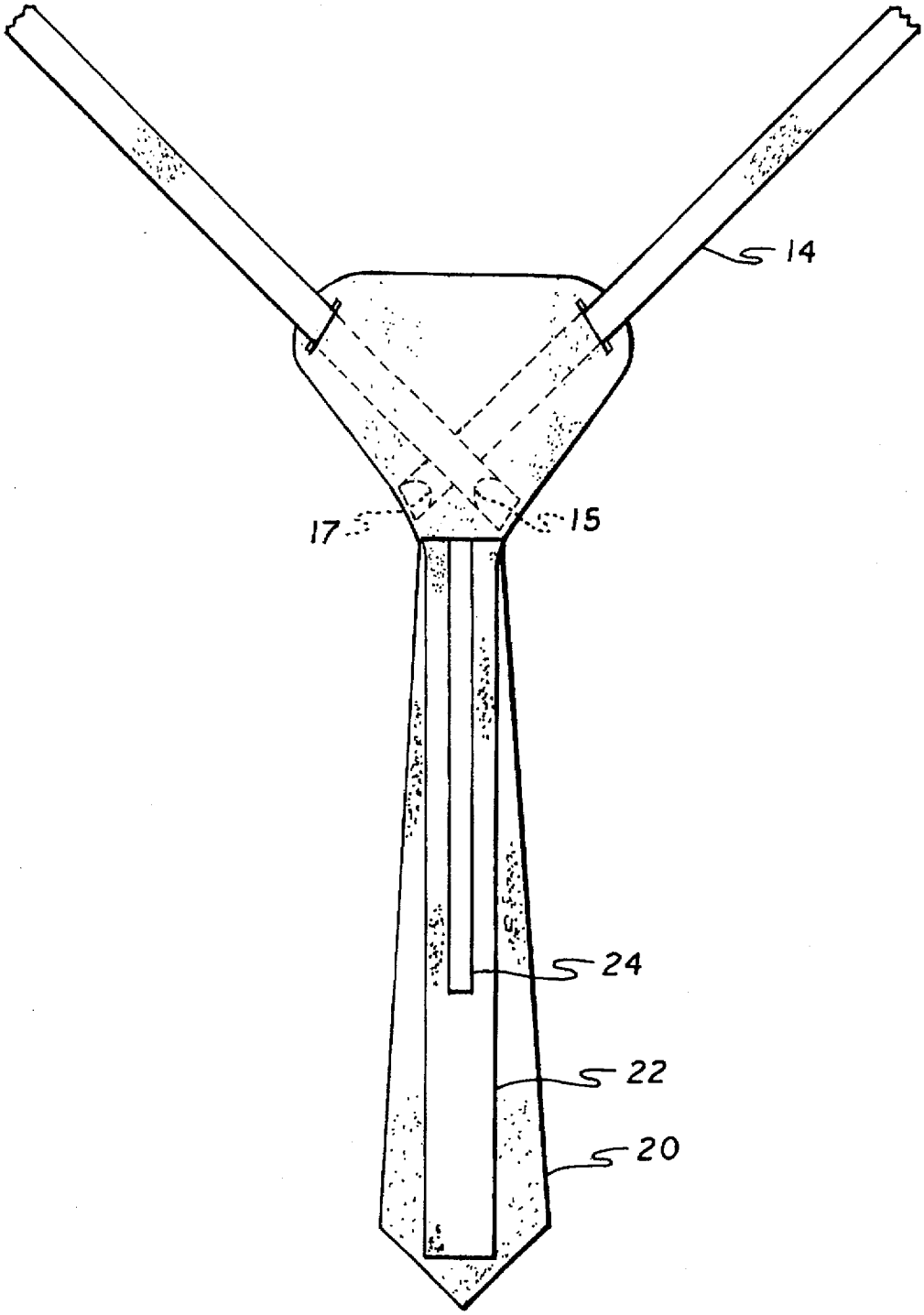
FIG. 3 is a rear elevational view of the invention.

Referring also to FIGS. 3 and 4, a first end 15 of the neck band 14 attaches to the left side of the front 19 of the insert sleeve 12 near its bottom. The neck band 14 wraps around to upper right of the back 13 of the insert sleeve 12. A second end 17 of the neck band 14 also attaches to the front 19 of the insert sleeve 12 and similarly wraps around the insert sleeve 12 in the opposite direction. The neck band 14 thus cross itself along the back 13 of the insert sleeve 12. The neck band 14 is attached to the insert sleeve 12, such as by stitching, from ends 15 and 17 to the crossing point 25 at which the neck band 14 crosses itself. Tightening the tie around the wearer's neck serves to pull the bottom of the insert towards the wearer's body because the neck band 14 is attached to the bottom of the insert sleeve 14. This prevents the normal gap at the neck when the bottom of a traditional tie knot protrudes away from the wearer's body due to its top corners being pulled tightly against the wearer's neck.

Referring again to FIG. 2, the neck band 14 has adjustment means 16 which facilitates adjustment of the neck band 14 about the wearer's neck. The adjustment means 16 provides for easy fastening and adjustment of the tie about the neck. Once in place, the adjustment means 16 should not loosen. The adjustment means 16 shown includes a slip cinch-type adjustment 18. The adjustment may be of the hook and pile-type (not shown), such as "Velcro®." Elastic (not shown) may be incorporated in the neck band 14 to ensure a snug fit. However, elasticized neckwear may become uncomfortable over time.

As more particularily shown in FIG. 2, the pretied necktie of the present invention includes a front body member 20 including a top portion 21 which covers the front 19 of the insert sleeve 12. The front body member 20 is constructed from material configured in any appropriate shape to appear like the wide end of a conventional tie.

A rear body member 22 including a top portion 27 which covers the back 13 of the insert sleeve 12. The top portion 27 of rear body member 22 has slits 23 symmetrically disposed on each side for receiving the ends 15 and 17 of neck band 14. The rear body member 22 is stitched to the front body member 20 from the top of the insert sleeve 14 to a point 4–8 inches from the bottom end 29 of the rear member 22. Any equivalent attachment means would be appropriate.

Figure 5:
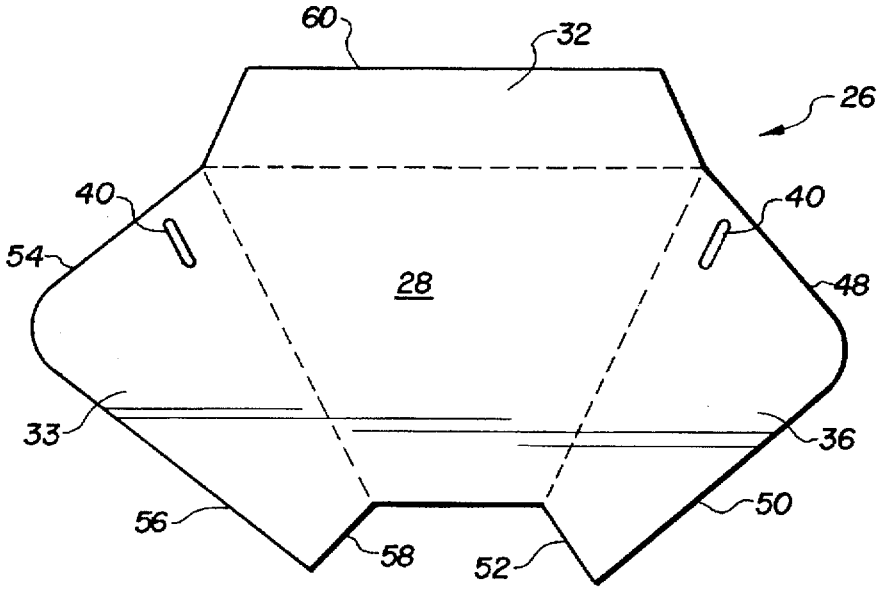
FIG. 5 is a plan view of the cover in a open position prior to assembly.

A cover 26 is shown in FIG. 5. The cover 26 includes a main front portion 28 from which extend a right tab 36, a left tab 33, and a top tab 32. The right tab 36 terminates at edges 48, 50, and 52. The left tab 33 terminates at edges 54, 56, and 58. The top tab 32 includes an edge 60. Slits 40 are included in both the right tab 33 and the left tab 36.

Figure 6:
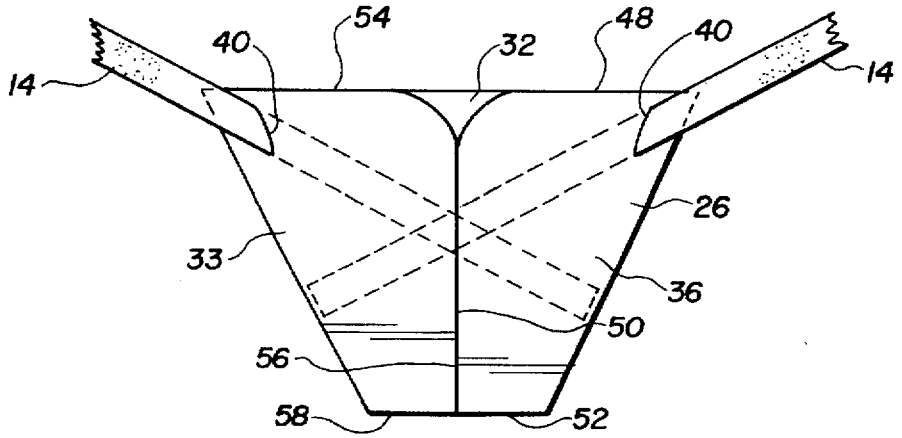
FIG. 6 is a rear elevational view of the cover assembled with the insert.

The cover 26 is installed around knot-shaped member 8. The top portion 21 of front member 20 and the top portion 27 of rear member 22 are held between the cover 26 and the insert sleeve 12 as shown in FIGS. 2 and 6. The front portion 28 (FIG. 5) of the cover 26 is installed over the top front member 20. The top tab 32 is folded over the top of the knot insert 10 and the edge 60 is stitched in place. The left tab 33 and right tab 36 are folded around the sides of the knot insert 10. The neck band 14 is passed through slits 40. The top edges 48 and 54 and the bottom edges 52 and 58 are stitched in place. Edges 50 and 56 are stitched in place in a manner to avoid stitching down neck band 14. Cover 26 installed over front member 20 completely encasing insert 10 and is stitched to the insert sleeve 14 to simulate the shape and appearance of a traditional knot.

The rear body member 22 has a button groove 24 as shown in FIGS. 1 and 2. The button groove 24 allows the wearer to secure the invention to the wearer's shirt front. The groove 24 begins immediately below the cover 26 and extends downward terminating 4–8 inches from the bottom of rear body member 22. The groove 24 engages a minimum of three button on the shirt front of the wearer to fashionably secure the tie in position. Securing the neckwear to the shirt front deters soiling and damage. The groove 24 provides for engagement of button at any intervals along the shirt front for perfectly arranging the neckwear with respect to the wearer's clothing.

The present invention is not intended to be limited to the sole embodiment described above, but to encompass any and all embodiments within the scope of the following claims.

We claim:

1. A pretied necktie comprising:

a knot-shaped member having from side, a rear side, a top, and a bottom;

a front body member having a top portion adjacent the front side of said knot-shaped member and a bottom portion depending therefrom;

a rear body member having a top portion adjacent the rear side of said knot-shaped member and a bottom portion depending therefrom and terminating at a bottom end;

a neck band attached to said knot-shaped member; and a cover encasing said knot-shaped member, the top portion of said front member, and the top portion of said rear member, said cover including slits, said neck band passing through said slits.

2. A pretied necktie comprising:

a knot-shaped member having front side, a rear side, a top, and a bottom. said tie knot-shaped member including an insert and an insert sleeve receiving said insert;

a front body member having a top portion adjacent the front side of said knot-shaped member and a bottom portion depending therefrom;

a rear body member having a top portion adjacent the rear side of said knot-shaped member and a bottom portion depending therefrom and terminating at a bottom end;

a neck band attached to said insert sleeve, said neck band having two ends, each of said ends being stitched to said insert sleeve at the front side proximate the bottom of said knot-shaped member, said neck band being crossed along the rear side of said knot-shaped member; and a cover encasing said knot-shaped member, the top portion of said front member, and the top portion of said rear member.

3. The pretied necktie according to claim 2 wherein said insert is constructed from malleable material.

4. The pretied necktie according to claim 1 wherein the top portion of said rear body member includes slits, said neck band passing through said slits.

5. The pretied necktie according to claim 1 wherein said cover includes:

a front portion disposed over the top portion of said front body member;

a top tab extending from said front portion, said top tab folded over the top of the top of said knot-shaped member;

a right tab extending from said front portion, said right tab folded around and stitched to said knot-shaped member; and a left tab extending from said front portion, said left tab folded around and stitched to said knot-shaped member.

6. The pretied necktie according to claim 1 wherein said neck band is attached proximate the bottom of said knot-shaped member.

7. The pretied necktie according to claim 1 wherein said rear body member includes a groove for engaging shirt buttons.

8. The pretied necktie according to claim 7 wherein said slot begins below said cover and terminates a distance from said bottom end.

9. The pretied tie according to claim 1 wherein said neck band includes adjustment means for tightening said neck band around a wearer's neck.

* * * * *